US005964272A

United States Patent [19]

Sieradzki

[11] Patent Number: 5,964,272

[45] Date of Patent: Oct. 12, 1999

[54] WHEEL COOLING TUNNEL

[75] Inventor: Christopher Z. Sieradzki, Monee, Ill.

[73] Assignee: Amsted Industries Incorporated, Chicago, Ill.

[21] Appl. No.: 08/986,588

[22] Filed: Dec. 8, 1997

[51] Int. Cl.[6] ..... B22D 23/00; C21D 9/04

[52] U.S. Cl. ..... 164/76.1; 164/130; 148/583

[58] Field of Search ..... 164/76.1, 130, 164/324; 148/583

[56] References Cited

U.S. PATENT DOCUMENTS 5,533,770 7/1996 Clausmeyer et al. ..... 148/583

FOREIGN PATENT DOCUMENTS 1123571 5/1982 Canada .

511649 8/1939 United Kingdom ..... 148/483

OTHER PUBLICATIONS

E–783.3–35 Date: Feb. 1976.

E–783.3–156 Date: Apr. 1976.

*Primary Examiner*—Harold Pyon
*Assistant Examiner*—I,-H. Lin
*Attorney, Agent, or Firm*—Edward J. Brosius; F. S. Gregorczyk; Stephen J. Manich

[57] ABSTRACT

The present invention provides a method of producing cast steel railway wheels. After pouring and removal from the mold, the steel wheel is processed in various steps including processing in an annealing and a tempering furnace. The wheel is then passed through a wheel cooling tunnel where the wheel is cooled from approximately 900° F. to about ambient temperature.

5 Claims, 2 Drawing Sheets

WHEEL COOLING TUNNEL

BACKGROUND OF THE INVENTION

The present invention relates generally to the casting and production of a cast steel railway wheel, and, more particularly to the cooling of such a cast steel railway wheel in a cooling tunnel after tempering.

The present invention represents improvements over the wheel casting method and apparatus set forth in Canadian Patent No. 1123571. The method and apparatus disclosed in that patent include a pouring station wherein metal is poured by a bottom pressure casting operation upwardly into two-piece molds comprising a lower drag section and an upper cope section. Shortly after pouring, the cope and drag sections are separated and the cast steel wheel is removed from the drag section. The wheel is gradually cooled when moving through a wheel kiln, and then subjected to certain processing operations including riser removal and hub cutting. The cast steel wheel is then passed through an annealing furnace, subjected to a water spray rim treatment operation, and then passed through a tempering furnace. At this time, the wheels were allowed to cool to ambient temperatures by simply placing the wheels vertically in storage inside the manufacturing facility. Such cooling operation typically took twenty-four hours and was considered a delay in the overall wheel manufacturing process.

It is an object of the present invention to provide an improved method and apparatus for the production of cast steel railway wheels, specifically relating to the cooling of such wheels after tempering.

SUMMARY OF THE INVENTION

The present invention provides an improved arrangement relating to the manufacture of cast steel railway wheels. The arrangement is particularly adapted, although not necessarily limited to, the use of permanent graphite molds each comprising a cope and drag section. Pouring ladles of molten metal are moved to a pouring station where the pouring tank accepts the ladle and is adapted for the bottom pressure pouring of the molten steel upwardly into the permanent mold arrangement. After such pouring, the mold arrangement with the cast steel wheel is moved along a conveyor system for a prearranged time period until the cope section can be removed from the mold. Shortly thereafter, the cast steel wheel is sufficiently solidified to be removed from the mold and placed into a series of processing stations including a wheel kiln, sprue removal station, a hub cutting station, a normalizing furnace for annealing, a water spray system for rim treatment, a draw furnace for tempering, and a water spray system for hub treatment. The present invention is related to the processing of the railway wheels upon exiting the hub treatment operation.

When exiting the hub treatment operation, the cast steel railway wheels are at approximately 900° F. It is desirable to cool such wheels in an arrangement that would be significantly more rapid than unassisted air cooling to ambient temperature which currently takes twenty-four hours. Accordingly, a wheel cooling tunnel has been proposed which would allow the cooling of such railway wheels from about 900° F. to about ambient temperature in about two hours.

Such wheel cooling tunnel is designed to be an in-line operation similar to the draw furnace but including forced air by the use of a fan or multiple fans to introduce enough ambient air into the in-line cooling tunnel to allow the desired cooling to take place. The wheels would be moved through the cooling tunnel in a manner similar to the draw furnace utilizing an overhead conveyor, with the air inlet and outlet being of the modes discussed in the detailed description.

DETAILED DESCRIPTION

Figure 1:
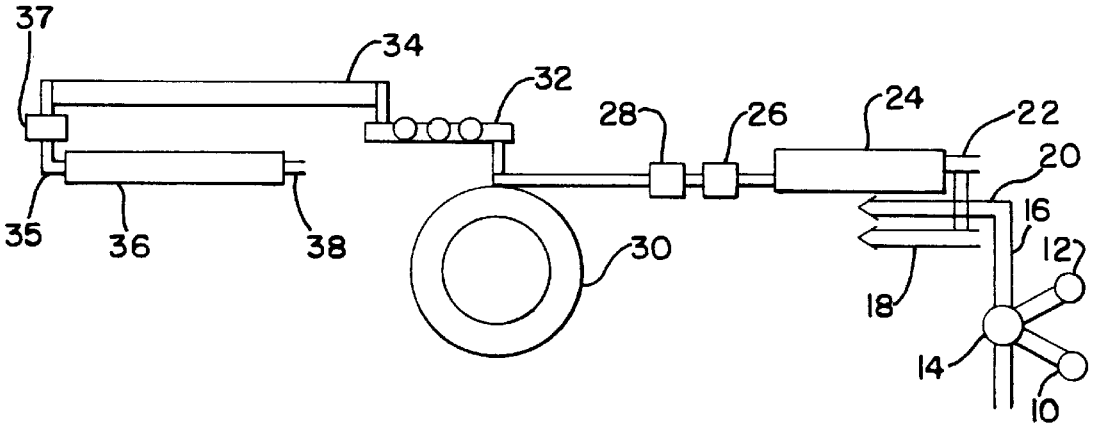
FIG. 1 is a diagram of the steel casting and cooling operation in accordance with the present invention.

Referring now to FIG. 1 of the drawings, two identical ladle preparation stations are shown at 10 and 12. These stations accommodate a preheated pouring ladle and receive molten steel from the melting source such as an electric arc furnace. When filled with molten metal, the ladle is rolled into pouring station 14. Pouring station 14 is capable of receiving a pouring tank with cover such that the pouring tank and metal ladle can be pressurized to allow the bottom pressure pouring of molten steel upwardly into the bottom of an assembled mold.

An assembled mold comprises an upper cope section and a lower drag section and is preferably comprised of a graphite material, although other mold components can be utilized. After a predetermined, the cope section of the mold can be removed and placed onto the cope conveyor line 18 for processing. The cast steel railway wheel is removed from the drag section and placed on wheel kiln conveyor 22. The drag section of the mold is placed on drag conveyor 20 and moved for further processing. Cast steel railway wheels are moved through wheel kiln 24 which is usually comprised of an unheated refractory side walled structure to allow gradual cooling of the cast steel railway wheels.

Upon exiting wheel kiln 24, the cast steel railway wheels are further processed through stations such as the sprue removal station 26 which usually comprises a grinding operation to remove the remainders of the risers on the upper surface of the cast steel wheel. Further processing is provided at the hub cutting station 28 wherein the bore through the hub of the wheel to ultimately receive the axle is cut, usually by a torch.

Upon exiting the hub cutting station 28, the cast steel railway wheels are moved into normalizing furnace 30 for annealing. Normalizing furnace 30 usually is comprised of a circular furnace with an internal moving conveyor mechanism into which the cast steel wheels enter and are exposed to elevated temperatures for about 1½ hours.

Upon exiting normalizing race 30, the cast steel railway wheels are passed into a rim treatment operation 32 wherein water is sprayed onto the rim to aid in hardening the tread surface of the wheel that will come into contact with the rail surface.

Upon exiting rim treatment 32, the wheels enter draw furnace 34 for tempering. The wheels pass through utilizing an overhead conveyor system wherein each wheel is hung on a hook and carried though draw furnace 34 for about 2 hours. The cast steel wheels exit draw furnace 34 at about 900° F. The wheel enters the hub treatment station 37 whereby cooling water is sprayed in the hub bore which was cut in station 28.

Figure 2:
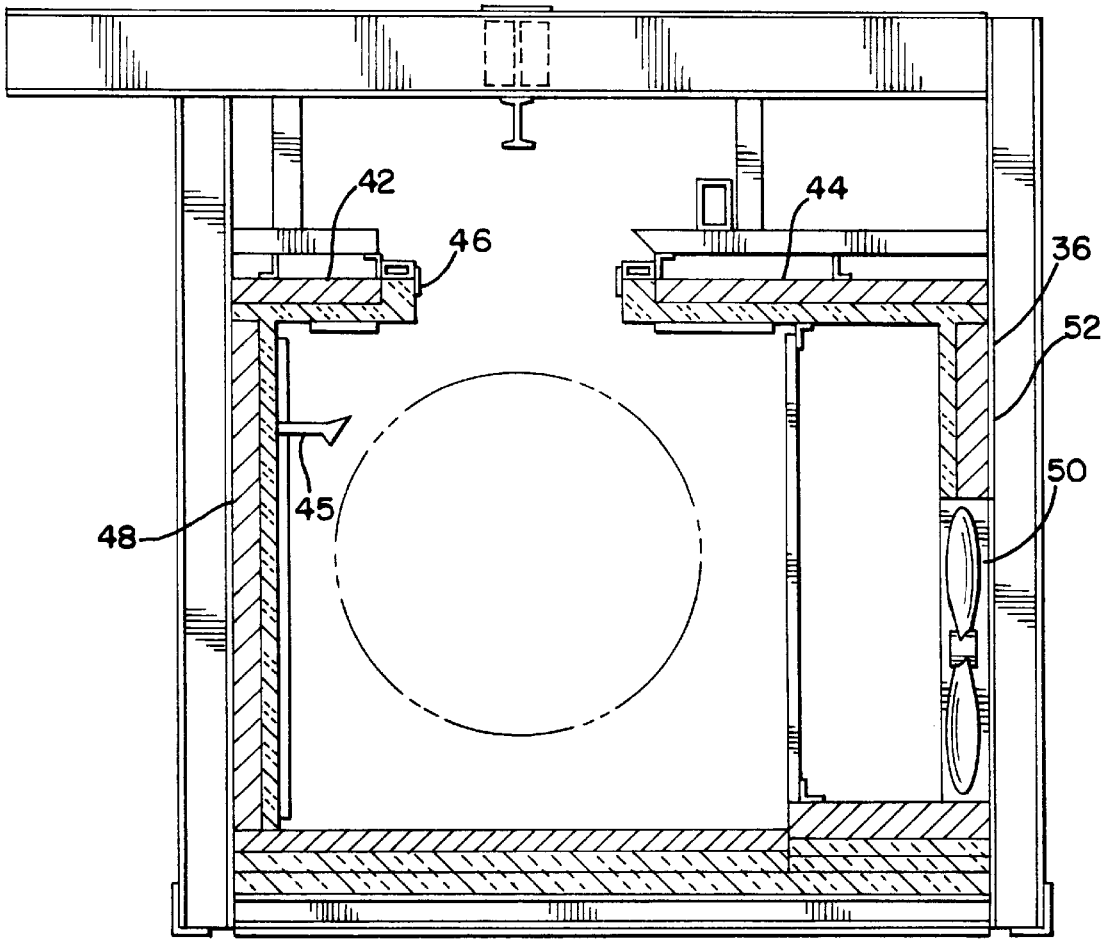
FIG. 2 is a lateral sectional drawing of the wheel cooling tunnel in accordance with the present invention.
Figure 3:
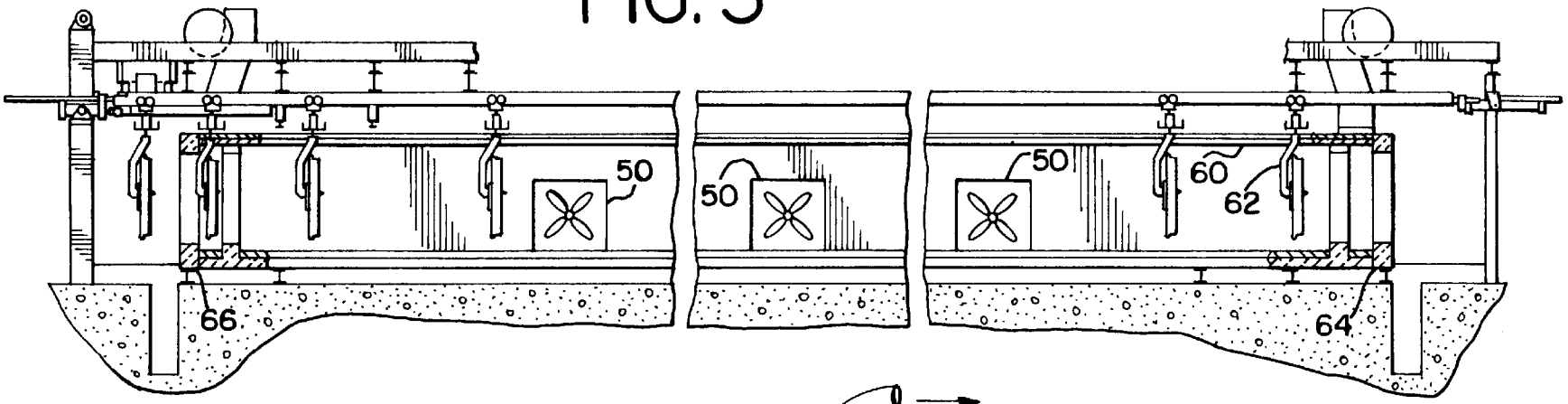
FIG. 3 is a horizontal partial sectional view of the wheel cooling tunnel in accordance with the present invention.

Upon exiting hub treatment station 34, the cast steel wheels are passed onto entrance 35 to wheel cooling tunnel 36. Referring now to FIGS. 2 and 3, a detailed view of wheel cooling tunnel 36 is provided. Wheel cooling tunnel 36 can be similar in structure to draw furnace 34, except of course that draw furnace 34 includes gas fired heating devices to keep the temperature inside draw furnace at a desired elevated level. Wheel cooling tunnel 36 includes air moving devices wherein accelerated cooling of the cast steel railway wheels passing through wheel cooling tunnel 36 is provided.

Wheel cooling tunnel 36 is typically comprised of various structural components. In general, wheel kiln 36 is comprised of a floor section 40 with side walls 48 and 52, all of refractory materials with steel structural components, extending vertically upward therefrom to form a generally elongated rectangular structure. The roof of wheel cooling tunnel 36 can comprise two sections 42 extending transversely from side wall 48 and section 44 extending transversely from side wall 52. Further a water mist can be provided by spray heads 45.

Side wall 52 is constructed to include openings to accommodate the mounting of fans 50 along its length. The number of such fans can vary depending on the overall length of cooling tunnel 36 and the number of wheels to be handled through cooling tunnel 36 and the air moving capacity of each fan. Typically, a wheel cooling tunnel would handle 60 wheels per hour. The air flow would accomplish the cooling of 60 wheels per hour from an entry temperature of about 900° F. at entry point 64 to about ambient temperature of the wheel plant, approximately 70° F., at exit point 66.

Continuing with the structure of wheel cooling tunnel 36, it is seen that a conveyor assembly 60 would extend above opening 46 in the roof to move various hook assemblies 62 along its length. Each hook assembly would carry one wheel through cooling tunnel 36. When exiting wheel cooling tunnel 36 at exit 66, each wheel is removed such that the conveyor assembly 60 around the outside of wheel cooling tunnel 36 and returns by a conveyor path outside of the wheel cooling tunnel 36 itself.

Figure 4:
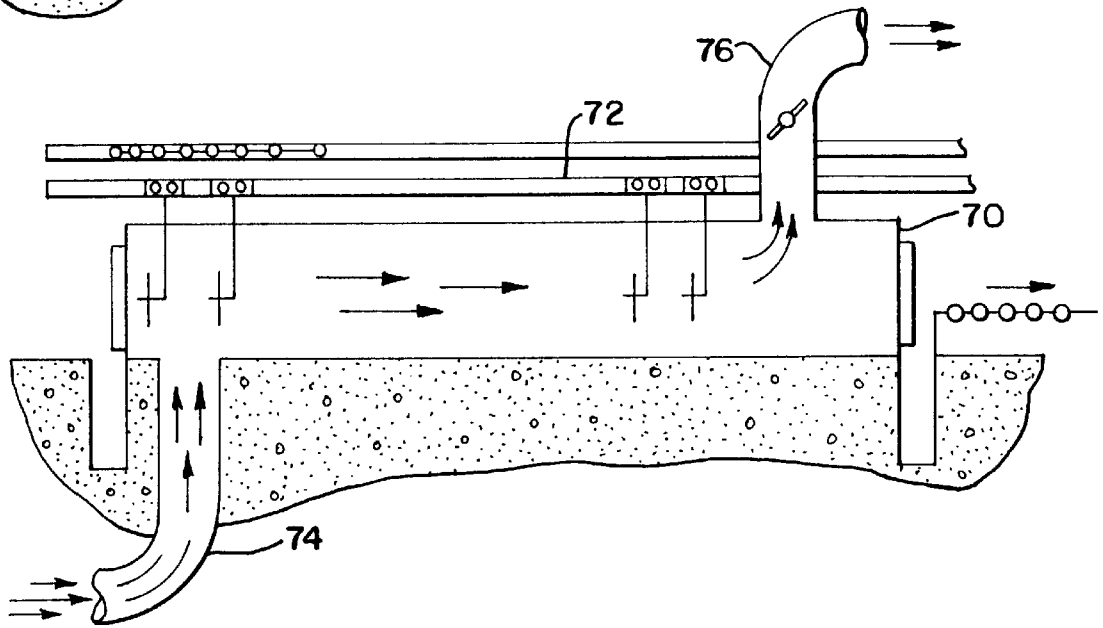
FIG. 4 is a diagrammatic view of an alternative wheel cooling tunnel in accordance with the present invention.

Referring now to FIG. 4, an alternate wheel cooling tunnel is shown at 70. This wheel cooling tunnel is similar to wheel cooling tunnel 36 in construction especially with regard to the conveyor system for moving wheels through conveyor system 72. However, a single air inlet is provided at 74 wherein a forced air fan or multiple fans would direct cooling air to a plenum the length of the cooling tunnel, but located below the suspended hot wheels. The plenum would have slots or suitable openings to direct high velocity streams of cooling air between each of the wheels to provide maximum surface area impingement of the hot wheel with cooling air. A draw fan or multiple draw fans could be provided to assist in air flow at the air exit.

What is claimed:

1. A method of producing a cast steel railway wheel comprising the steps of assembling a mold by placing a cope section on a drag section and moving said assembled mold to a pouring station, pressure pouring molten steel upwardly through a pouring tube into said assembled mold, moving said filled assembled mold to a mold disassembly station where said cope section is removed and said cast steel railway wheel is removed from said drag section, removing sprues from said cast steel railway wheel, annealing said cast steel casing steel wheel in a beat treatment furnace, rim treating said cast steel railway wheel in a water spray operation, tempering said cast steel railway wheel in a draw furnace, hub treating said cast steel railway wheel in a water spray operation, cooling said cast steel railway wheel in a cooling tunnel by moving said cast steel railway wheel through said cooling tunnel in about two hours while moving air through said cooling tunnel at a rate sufficient to cool said cast steel railway wheel from a temperature of about 900° F. when entering said cooling tunnel to near ambient temperature when exiting said cooling tunnel wherein the cooling tunnel comprising a plurality of fans for cooling the said wheel.

2. The method of claim 1 wherein said air moving through said cooling tunnel is accomplished by a plurality of fans distributed along the longitudinal extent of said cooling tunnel, said cooling tunnel comprising an elongated structure having two open ends one of which receives said cast steel railway wheel and the other of which exits said cast steel railway wheel.

3. The method of claim 2 wherein each of said fans is mounted at a lateral side of said wheel cooling tunnel to introduce ambient air into cooling tunnel.

4. The method of claim 3 wherein a water mist is provided in addition to the intuition of ambient air into said cooling tunnel to assist in cooling said cast steel railway wheels.

5. The method of claim 1 wherein a conveyor mechanism is provided whereby each cast steel railway wheel is suspended from a hook extending from a conveyor system into a top section of said cooling tunnel to move said cast steel railway wheels through said cooling tunnel.

* * * * *